United States Patent [19]

Juhola et al.

[11] Patent Number: 4,537,527

[45] Date of Patent: Aug. 27, 1985

[54] MEANS FOR PROVIDING A VERTICAL DRAIN IN SOIL

[75] Inventors: Mauno O. Juhola, Helsinki; Matti Numminen, Espoo, both of Finland

[73] Assignee: Pohjavahvistus Oy, Helsinki, Finland

[21] Appl. No.: 383,167

[22] Filed: May 28, 1982

[30] Foreign Application Priority Data

Mar. 19, 1982 [FI] Finland ..... 820951

[51] Int. Cl.[3] ..... E02B 11/00; E02D 3/10

[52] U.S. Cl. ..... 405/50; 405/36

[58] Field of Search ..... 405/36, 38, 43, 45, 405/50, 156; 52/108

[56] References Cited

U.S. PATENT DOCUMENTS

| | | | |
|---|---|---|---|
| 2,577,252 | 12/1951 | Kjellman | 405/45 |
| 3,720,063 | 3/1973 | Shono | 405/50 |
| 3,797,251 | 3/1974 | Shimizu | 405/50 |
| 3,797,252 | 3/1974 | Ohtsuka | 405/50 |
| 3,891,186 | 6/1975 | Thorsell | 405/36 X |
| 4,166,508 | 9/1979 | van der Berg | 405/50 X |

FOREIGN PATENT DOCUMENTS

| | | | |
|---|---|---|---|
| 2837155 | 2/1980 | Fed. Rep. of Germany | 405/50 |
| WO81/03354 | 11/1981 | PCT Int'l Appl. . | |

*Primary Examiner*—Cornelius J. Husar
*Assistant Examiner*—Nancy J. Stodola

[57] ABSTRACT

Apparatus for providing a vertical drain in the soil, comprising a push tube to be pushed into the soil and which carries within it a prefabricated drain, provided with an anchor on the lower end, said prefabricated drain remaining in its place with the aid of an anchor while the push tube is being pulled back upwards. The push tube carries within itself a cut-off device at its lower end for the prefabricated drain, cutting it at desired height. Thereafter, the push tube is, if needed, lifted up for another anchor to be affixed to the lower end of the prefabricated drain. The object of the invention is to achieve that the prefabricated drain that has been cut off inside the push tube is pushed out from the lower end of the push tube. As taught by the invention, the push tube carries inside itself above the cut-off device pushing members which are located on both sides of the prefabricated drain and press the prefabricated drain between themselves with the aid of operating member and move it downwards so that the lower end of the prefabricated drain will project below the lower end of the push tube for another anchor to be affixed to the lower end of the prefabricated drain.

5 Claims, 5 Drawing Figures

Figure 3:
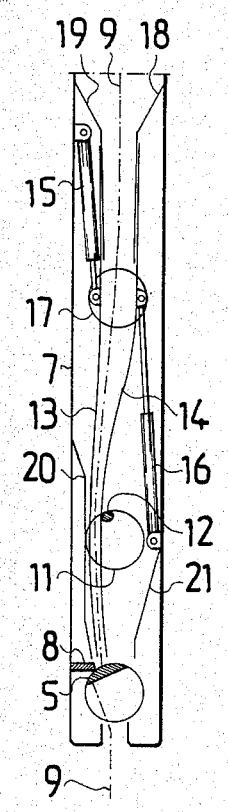

Fig.1
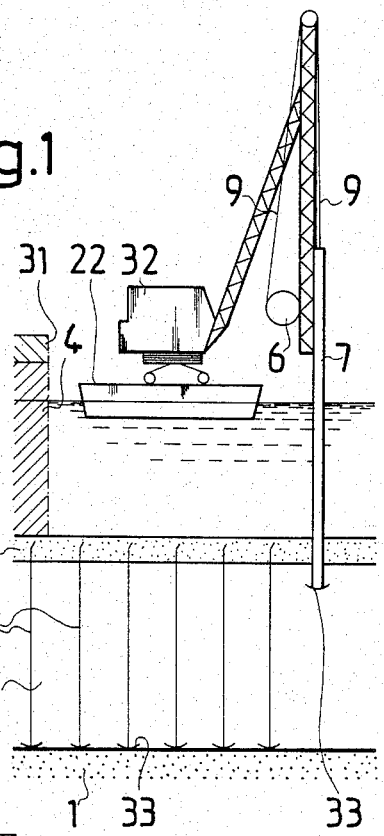
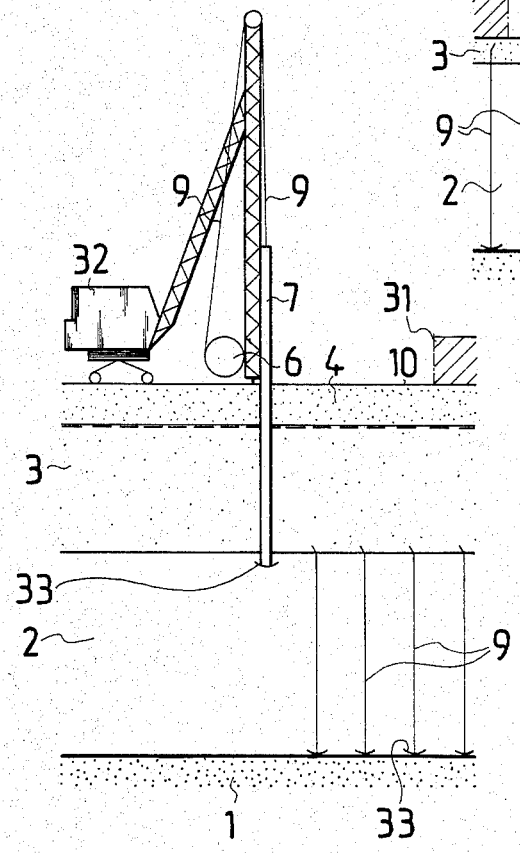
Fig.2

MEANS FOR PROVIDING A VERTICAL DRAIN IN SOIL

The present invention is applied when prefabricated drains are used for compacting water-carrying and fine-grained soil with low water permeability, such as clay, silt, etc., by means of dewatering the soil draining it vertically and thus reducing the water content of the soil matter. The bearing capacity of the ground will in this way be improved, settlings expected to take place are accelerated, while the shearing strength of the soil is increased.

For purposes of vertical draining, various prefabricated drains have been devised, e.g. drains made of profiled, about 10 cm broad plastic strip material and of porous paper or other similar water-permeable filtering material wound around the strip.

A vertical prefabricated drain is established into the soil by pushing it by means of a particular push tube into desired depth, vertically as a rule. The prefabricated drain is located within the push tube, and the lower end of the prefabricated drain is anchored by means of a particular anchor in its place. After establishing, the push tube is pulled out, whereby the prefabricated drain remains in the soil. The prefabricated drain is cut off at a suitable height. Depending on the soil bottom conditions, and the aims, prefabricated drains of this type are disposed with a suitable spacing, for instance at intervals of one to two meters on the area to be strengthened. Water from the soil drains through the porous paper into channels in the prefabricated drain, wherefrom it ascends and runs off.

Particularly noteworthy is that by vertically draining it is possible to dewater and compact a clay or mud layer, with a thickness which may be tens of meters, on the bottom of a sea or lake. Vertical draining is necessary when a particular site on the sea or lake bottom is designed to be filled e.g. for building a road, railway or even an air field. If the soft, compressible clay or mud layer is not drained vertically before filling, it takes tens of years before the compressible layers are settled by effect of the filling and other loads applied on top of them. By draining vertically, the settling can be accelerated to take place in a year or two, or even in a few months' time, depending on the conditions on the bottom and on the spacing of vertical drains. The amount of the settlements may be up to several meters depending on the bottom conditions and loads.

There are various procedures and means by which the operation takes place. Above all, this regards the way in which the prefabricated drain is cut off after the push tube is pulled up to desired height. The publication WO 81/03354 presents a cutting-off means which is located within the push tube. This means offers remarkable advantages because the cutting can take place in the soil in a permeable soil layer whereto water can escape from the prefabricated drain. The prefabricated drain, therefore, need not be extended up to the ground surface. On the other hand, the cutting can take place above the bottom of the water body so that the prefabricated drain need not be extended up to the water surface to be cut off. The means known in prior art presents the problem of how to extract the cut-off lower end of the prefabricated drain (located within the push tube) from the push tube so that an anchor can be affixed to it.

Therefore, the object of the present invention is a means for providing a vertical drain in the soil, comprising a push tube to be pushed into the soil, carrying a prefabricated drain within it, provided with an anchor on its lower end, which, while the push tube is being pulled back upwards, remains in its place by means of the anchor, within which push tube a cutting-off means of the prefabricated drain is located on its lower end, cutting the prefabricated drain at desired height, whereafter the push tube, if necessary, is pulled up so that another anchor can be affixed on the lower end of the prefabricated drain.

The invention is characterized that for pushing the lower end of the prefabricated drain, located within the push tube, out of the push tube after it has been cut, the push tube carries within itself pushing members above the cutting-off means, which members are located on both sides of the prefabricated drain and which by the aid of operating means press the prefabricated drain in between themselves and move it downwards so that the lower end of the prefabricated drain protrudes underneath the lower end of the push tube, for another anchor to be fixed to the lower end of the prefabricated drain. Thereby, the prefabricated drain can be made to emerge with ease. Naturally, the same work could be carried out also manually by e.g. grasping the lower end of the prefabricated drain with tongs and pulling it out, but in the circumstances of operation, this is extremely awkward and even dangerous.

According to an advantageous embodiment of the invention the pushing members consist of longitudinal flaps within the push tube. Therefore, they grasp the prefabricated drain on a great length and ensure that the prefabricated drain will not be damaged.

Another advantageous embodiment of the invention is characterized in that the flaps when in the lower position extend to a point below the lower end of the push tube. Hereby, the prefabricated drain will positively emerge from the lower end of the push tube. At the same time, the flaps will push out mud and ooze which may enter the push tube at the phase when it is being pulled upwards.

The invention is described in the following by means of an example, referring to the drawing attached, wherein FIG. 1 presents a means for making vertical drains on the bottom of a water body.

FIG. 2 presents a situation wherein prefabricated drains are established in a clay or mud layer, working from the dry land.

Figure 4:
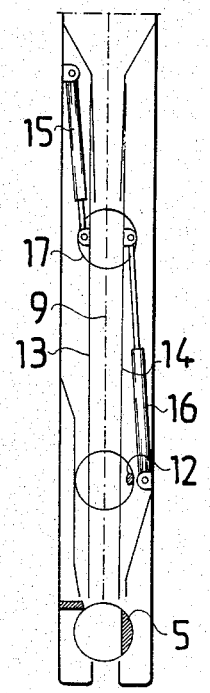
Figure 5:
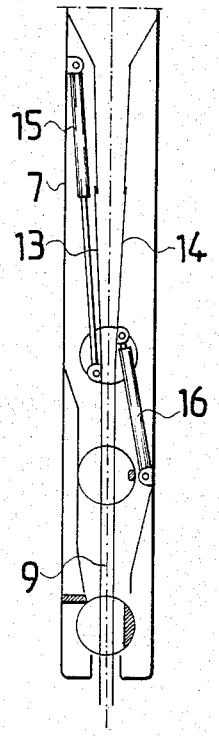

FIGS. 3–5 present the section of the lower end of a push tube according to an embodiment, in various working positions.

FIG. 1 presents a case in which the prefabricated drains 9 are established in a clay layer 2 on the bottom of a water body, e.g. a sea, by means of a working machine 32 on a pontoon 22, this machine being provided with a push tube 7 movable vertically. While the push tube 7 is in its top position with its lower end above the water surface, the anchor 33 is affixed to the lower end of the prefabricated drain 9 from a stock reel 6. Before commencing the operation, a sand layer 3 permeating water may be supplied in the sea bottom. The push tube 7 is pushed through layers 3 and 2 all the way to the hard bottom 1. In the position shown in FIG. 1, the push tube is just entering the clay layer 2. As the pulling up of the push tube is commencing, the anchor 33 and the prefabricated drain 9 affixed thereto remain stationary. The push tube 7 is pulled upwards so that the cutting-off means within it (FIGS. 3–5) is located in the sand layer 3. The prefabricated drain 9 is cut off, and the push tube is lifted to its top position. Thereafter, the pontoon 22 is moved a little and another prefabricated drain 9 is established in the clay layer 2. After establishing the prefabricated drains 9, earth filling 4 is conveyed thereupon. Upon the earth filling can also be deposited an excess embankment 31 to speed up settling.

FIG. 2 presents a case in which lowermost is a hard bottom 1, on top thereof a clay layer 2, and on top of this, water-permeable natural soil or an earth filling layer 3. Establishing prefabricated drains 9 takes place by means of a push tube 7 located in the working machine 32 moving on the ground 10. While the push tube 7 is in its upper position, whereby its lower end is above the surface of the ground, an anchor 33 is affixed to the lower end of the prefabricated drain 9 supplied from the stock reel 6. Thereafter, the push tube 7 is pushed through the layers 3 and 2 to the hard bottom 1. In the position in FIG. 2 the push tube is just entering the clay layer 2. As the pulling up of the push tube is commencing, the anchor 33 and the prefabricated drain 9 affixed thereto remain stationary. The push tube 7 is pulled up such a length that the cutting-off means (FIGS. 3–5) therewithin will be positioned a given distance above the clay layer 2. The prefabricated drain 9 is cut off and the push tube lifted to the top position. Thereafter, the work machine 32 is moved a little and another prefabricated drain 9 is established in the clay layer 2. After establishing the prefabricated drains 9, earth filling 4 is conveyed thereupon. Upon the earth filling can also be deposited an excess embankment 31 to speed up settling.

As shown in FIG. 3, the lower end of the push tube 7 is provided with a cutting-off means for the prefabricated drain 9. This consists of rotatably carried cutting-off blade 5 and a stationary counter-blade 8 mounted on opposed walls of the push tube 7 rectangular in cross-section. Above the cutting-off means 5,8 is located a braking means. This consists of disks 11 rotatably carried on the opposite walls of the push tube 7 and of a braking rod 12 connecting them. The cutting-off blade 5 and the braking means 11,12 have been connected together e.g. by means of a chain transmission so that they operate in synchronism.

As seen in FIG. 3, the prefabricated drain 9 is located between two flaps 13 and 14 which in this embodiment constitute the pushing members according to the present invention. The flaps 13 and 14 are located longitudinally to the push tube 7 and their length is considerably greater than their width. The flap 13 is pivotally connected to the piston rod of a pressure cylinder 15. The flap 14 in its turn is pivotally connected to the piston rod of a pressure cylinder 16. Furthermore, the piston rods have mutually been connected with an intermediary member 17 which under guidance by the piston rods can turn and more vertically. The pressure cylinder 15 is directed upwards from the intermediary member 17 and pivotally connected to the inner surface of the push tube 7. The pressure cylinder 16 in its turn has been directed downwards from the intermediate member 17 and pivotally connected to the inner surface of the push tube 7. As seen in FIG. 3, the push tube also contains guide plates 18–21 for guiding the prefabricated drain 9.

FIG. 3 presents the situation in which the prefabricated drain has just been cut off. The lower end of the push tube 7 is now located above the clay layer 2. The braking rod 12 has pressed the flaps 13,14 e.g. of spring steel, and the prefabricated drain therebetween, against the guide plate of the prefabricated drain 9. Hereby the prefabricated drain is held in its place with reference to the push tube 7. The push tube 7 now continues its upward travel until its lower end is above the water surface as in FIG. 1, or above the ground level as in FIG. 2. The prefabricated drain 9 follows along.

When the push tube 7 has reached its upper position, the cutting-off blade 5 and the braking rod 12 turn to the position seen in FIG. 4. Simultaneously, the pressure cylinders 15 and 16 start turning the intermediary member 17 counterclockwise, whereby the flaps 13 and 14 are pressed against each other and grasp the prefabricated drain 9. The pressure cylinders 15 and 16 thereafter move the flaps 13 and 14 and the prefabricated drain 9 between them downwards as shown in FIG. 5. Thereafter, pressure cylinders 15 and 16 and the flaps 13 and 14 return to the position seen in FIG. 4. An anchor 33 may now be attached to the lower end of the prefabricated drain 9. The anchor remains resting against the lower end of the push tube 7. Thereafter, the push tube is displaced laterally to another position, and it is once more pushed down to the hard bottom 1. The operations according to FIGS. 4 and 5 may naturally be carried out at any stage after the prefabricated drain 9 has been cut off and before the push tube 7 is once again pushed down.

It is obvious to a person skilled in the art that various embodiments of the invention may vary within the scope of the claims stated below. For instance, there may be a plurality of flaps 13,14 one after another longitudinally in the push tube 7, each of them being provided with an operating means. Instead of the pressure cylinders 15, 16 may be contemplated as operating means mechanical means controlled from the upper end of the push tube 7. Instead of flaps 13,14 may also be used pushing members of other kind like e.g. one or several consecutive pairs of eccentric rollers which step by step push the prefabricated drain 9 downwards.

Instead of the cutting-off blade 5 rotating about its axis one may use a blade, moving rectilinearly in horizontal direction and co-operating with the counter-blade 8. The cutting-off means 5,8 and the braking means 11, 12 need not necessarily operate in synchronism.

In the foregoing has been mentioned that the push tube 7 has a rectangular cross-section. Equally, it can have a circle, oval or other etc. cross-section.

In the foregoing has been mentioned that the anchor 33 is affixed to the lower end of the prefabricated drains 9 above the water surface. It can, however, be also affixed near the bottom of the water body, if from the working machine 32 is extended downwards into the water a conveying member which affixes the anchor automatically. In this case, time and energy are saved because the push tube 7 need not be lifted above the water surface.

I claim:

1. Apparatus for making a vertical drain in soil, comprising a push tube to be pushed into and pulled up from the soil and which carries within it a prefabricated drain having an anchor on a lower end thereof which aids in keeping the prefabricated drain stationary when the push tube is being pulled upwards, a cutting-off means carried within said push tube at a lower end thereof for cutting the prefabricated drain at a desired height which is within said tube, pushing means provided within said push tube above the cutting-off means for pushing a leading uncut end of the prefabricated drain within said tube to a point that is below the bottom end of the tube, said pushing means comprising pressing means mounted on both sides of the prefabricated drain and arranged to press against the prefabricated drain from opposite sides, and operating means for actuating said pressing means to press the prefabricated drain therebetween and move said pressing means and prefabricated drain downward together a desired length in said push tube so that said leading uncut end protrudes below the bottom end of the tube, whereby another anchor can be affixed to the lower uncut end of the prefabricated drain protruding from the push tube for use with a new drain section after the push tube is pulled up.

2. Apparatus according to claim 1, wherein said pressing means comprise pushing members in the form of flaps located longitudinally with respect to the push tube.

3. Apparatus according to claim 2 wherein the flaps extend below the lower end of the push tube when moved downwards by said operating means.

4. Apparatus according to claim 2, wherein said operating means comprise hydraulic cylinders in substantial longitudinal alignment with said push tube and having their piston rods respectively pivotally connected to said flaps, the piston rods each having one end connected to a turntable intermediary member provided between connection points to the flaps, said hydraulic cylinders extending in opposite directions and having their ends opposite said one end of said piston rods pivotally connected to the inner surface of the push tube.

5. Apparatus according to claim 2, wherein braking means is provided adjacent to the flaps arranged to press the flaps against the prefabricated drain as the drain is cut off by the cutting-off means, whereby to keep the drain stationary in place until pushing action of the flaps is started.

* * * * *